US006904732B1

(12) United States Patent
Richmond

(10) Patent No.: US 6,904,732 B1
(45) Date of Patent: Jun. 14, 2005

(54) DEVICE AND METHOD FOR INSTALLING BUILDING MATERIAL

(76) Inventor: Frank M. Richmond, 205 A Grant St., Haryard, IL (US) 60033-3129

( * ) Notice: Subject to any disclaimer, the term of this patent is extended or adjusted under 35 U.S.C. 154(b) by 423 days.

(21) Appl. No.: 09/722,949

(22) Filed: Nov. 27, 2000

(51) Int. Cl.[7] ..... E04F 21/18; E04G 2/14

(52) U.S. Cl. ..... 52/749.1; 52/127.1; 52/745.12; 52/745.05

(58) Field of Search ..... 52/745.05, 745.1, 52/745.12, 749.1, 127.1, 127.2, 127.8, DIG. 1; 411/400, 401; 269/102, 904

(56) References Cited

U.S. PATENT DOCUMENTS 2,717,562 A * 9/1955 Ewing ..... 52/549
3,871,054 A * 3/1975 Schaefer ..... 29/267
3,904,184 A * 9/1975 Kureger ..... 269/102
3,951,236 A 4/1976 Schreiber et al.
4,158,455 A * 6/1979 Brown ..... 269/102
4,208,799 A * 6/1980 Frantello ..... 33/647
4,425,714 A * 1/1984 Kelly, Jr. ..... 33/646
4,449,338 A * 5/1984 Reicherts ..... 52/127.8
4,485,543 A * 12/1984 Flores et al. ..... 29/281.1
4,535,525 A 8/1985 Varon et al.
4,609,170 A 9/1986 Schnabl
4,709,460 A * 12/1987 Luhowyj ..... 29/271
4,709,527 A * 12/1987 Cooley ..... 52/749.1
4,889,459 A * 12/1989 Anderson ..... 411/400
4,995,605 A 2/1991 Conville
5,002,446 A 3/1991 Anderson
5,131,205 A * 7/1992 Hermann ..... 52/745.05
5,280,982 A 1/1994 Kobayashi
5,299,403 A * 4/1994 Fentz ..... 52/404.2
5,320,470 A 6/1994 Russell
5,325,641 A 7/1994 Felton
5,366,329 A 11/1994 Burgess
5,371,994 A * 12/1994 Waters ..... 52/749.1
D362,812 S * 10/1995 Meyer ..... D10/64
5,564,236 A * 10/1996 McKinney et al. ..... 52/127.2
5,617,698 A * 4/1997 Guilmette ..... 52/749.1
5,655,337 A * 8/1997 Bryant et al. ..... 52/127.2
5,702,218 A 12/1997 Onofrio
5,884,447 A * 3/1999 Earp ..... 52/489.1
5,921,058 A * 7/1999 Brooker ..... 52/749.1
6,131,361 A * 10/2000 Murphy ..... 52/712
6,161,824 A * 12/2000 Gustavson ..... 269/43
6,293,058 B1 * 9/2001 Sink ..... 52/127.1
6,364,303 B1 * 4/2002 Gustavson ..... 269/37
6,467,236 B1 * 10/2002 Schlegel ..... 52/749.1
6,494,016 B1 * 12/2002 Bankson ..... 52/749.1

* cited by examiner

*Primary Examiner*—Brian E. Glessner
(74) *Attorney, Agent, or Firm*—Fitch, Even, Tabin & Flannery

(57) ABSTRACT

The present invention provide an apparatus, devices and/or systems for the installation of building material which allows one individual on his own to install building material. The device includes at least one resting surface spaced apart from a fastener.

25 Claims, 18 Drawing Sheets

DEVICE AND METHOD FOR INSTALLING BUILDING MATERIAL

The present invention relates to installation of building materials, and more particularly, to devices that temporarily secure building materials, either overhead or on walls, until the installer can permanently secure the material into position

BACKGROUND

The burdensome task of installing building materials, such as drywall, is usually cumbersome and labor intensive. The process of installing these large, cumbersome and heavy drywall sheets for covering walls and ceilings usually has been assigned to two or more people. In order to correctly install drywall as ceiling sheets or wall sheets, the drywall sheets must first be lifted and placed into the desired position. With the drywall sheet being supported by at least one person, a second person must then secure the drywall sheet to the overhead joists or wall joists via a means of attachment, one of the more common ways being with screws. Usually screw guns are employed to speed up the process. While a minimum of two people are usually desired for this particular job, sometimes one person is left to accomplish this task all by thereself. This usually involves the installer balancing the panel on his head and/or using a tee bar (a tee bar is usually constructed from two pieces of 2"×4" wood with the vertical leg being 2" to 3" longer than the height of the ceiling) to free his hands in order to apply the means of attachment to attach the sheet of drywall to the structure. This practice is dangerous, leaves little room for adjustments and potentially adds to the amount of scrapped material. Therefore, there is a need for an invention which can temporarily hold a drywall sheet or other building materials in place while the installer is able to do final adjustments to the location and permanently secure the panel to the supporting joists.

One example of a device for aiding in the installation of drywall sheets and other building materials is described in U.S. Pat. No. 5,366,329. This patent describes a rotatable device having an integral "Z" shaped body is used to temporarily hold the drywall panel to the ceiling. This device is only capable of being rotated and does not have the option to be locked in a secure position. This causes a problem if the drywal sheet needs to be adjusted to properly fit into the desired position. Likewise, a problem exists when abutting one piece of dry wall next to another. Hence, an installer using the device still requires a minimum of one hand to hold the dry wall in place while the other secures it to the ceiling joists. Further, the device requires multiple components to manufacture it in its simplest form and requires the use of a relatively expensive shoulder screw. With frequent use of the shoulder, the screw head strips, requiring disassembly of the device to replace the screw.

Another device used to facilitate the installation of building materials is described in U.S. Pat. No. 5,002,446. This patent describes an overhead support device with an angled surface and widened edges. A tapered screw is embodied inside the housing which is used to secure the support device to the ceiling joists. The panel rests in the gap between the ceiling joist and the top of the housing. However, this device needs to be manually screwed in which is labor intensive, strenuous and time consuming. Furthermore, this device has the ability to possibly damage the building material when it is adjusted into its final position.

Therefore, there exists a need for an apparatus, device, or devices that can be quickly attached to a support structure, such as a ceiling or wall joist, that can be used in multiple surroundings to facilitate the installation of building materials which reduces the effort, the number of people needed to perform the task and preferably leaving both hands free to secure the material.

SUMMARY

The present invention provides an effective and convenient apparatus, devices and/or system for installing building materials either on ceilings or on walls. The apparatus and/or devices allows one individual on his own to install building materials. The invention eliminates the need for one or more persons holding the drywall in place while an initial means of attachment is applied to hold the sheet of drywall in place, thus, allowing an installer to remove the support of their head, or lower their arms. Further, while a first installer is using the devices of the present invention, an additional person(s) can be securing more devices or moving the existing devices in order to be ready to apply the next sheet of drywall. The devices of the present invention provide hands free operations and simplify the job for a 'do it yourself' (D.I.Y.) individual or homeowner while eliminating the need to enlists the help of a friend or friends in order to lift the sheet of drywall and hold it in place until the initial means of attachment are in place or rental of a drywall lift. The use of the devices of the present invention gives individuals who do not normally do strenuous work the ability to relatively simply apply drywall on their own, the only requirement is being their ability to lift a sheet of drywall without help.

In accordance with the present invention, the apparatus for installing building materials includes at least one resting surface 50 spaced apart from a fastener. Further in accordance with the present invention, the devices of the invention are first positioned adjacent to where an installer would like to install the building material. The apparatus of the present invention is attached to an existing structure. Once the apparatus of the invention is attached, the installer may then position a section of building materials so that it contacts a resting surface 50. Contacting the resting surface may be further facilitated with the use of a guide surface 70. The building material is then positioned and may be further secured with another device of the apparatuses and/or device of the invention.

DETAILED DESCRIPTION

The apparatus of the present invention is effective for installing building materials either overhead or on walls. As used herein the term "building materials" includes sheet drywall; paneling, sheet or plank; insulation board, plywood, siding, tongue and grooved planks, framing out of duct work, any form of wood sheet, wood composite sheet, rigid plastic sheet, plastic laminated sheet, expanded plastic (foam sheets), and, any other form of sheet material or planking.

The apparatus of the present invention may be made of a variety of materials including wood, metal, plastic and combinations thereof. The devices shown in FIGS. 1 through 4 and 8 would generally and more appropriately be made of wood; molded in plastic; molded in a filled plastic; a powdered metal or cast in metal and the devices shown in FIGS. 5 through 7 would generally and more appropriately be made of metal; filled plastic; plastic or powdered metal. If the device as shown in 5 through 7 was made in plastic then a person skilled in the art would probably include a support web for both extended target surfaces 76 and 77 running at an angle from a point on the back of the surfaces to the underside of surface 50 and/or the underside of adjacent mounting surface.

Figure 1:
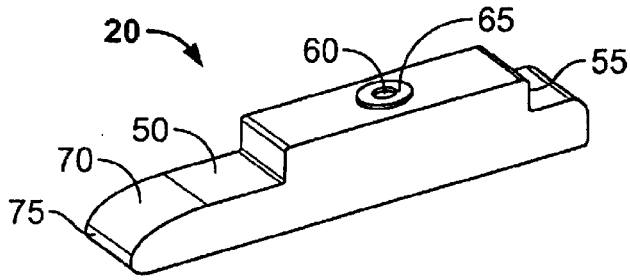
FIG. 1 shows a device for supporting building material during installation prior to securing it in its final location, with two resting surfaces and a feature to facilitate mounting the device.
Figure 2:
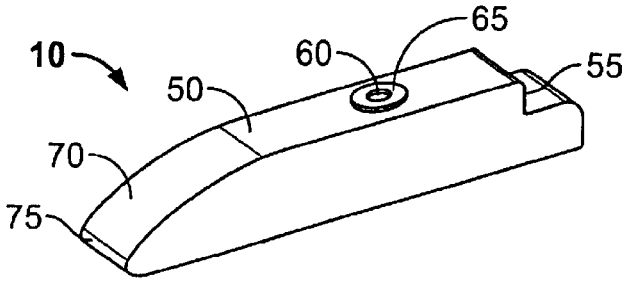
FIG. 2 illustrates a similar device to FIG. 1 for supporting building material during installation prior to securing it in it's final location, with two resting surfaces, one of the resting surfaces being an extension of the surface that is the adjacent mounting surface and a feature to facilitate mounting the device.
Figure 3:
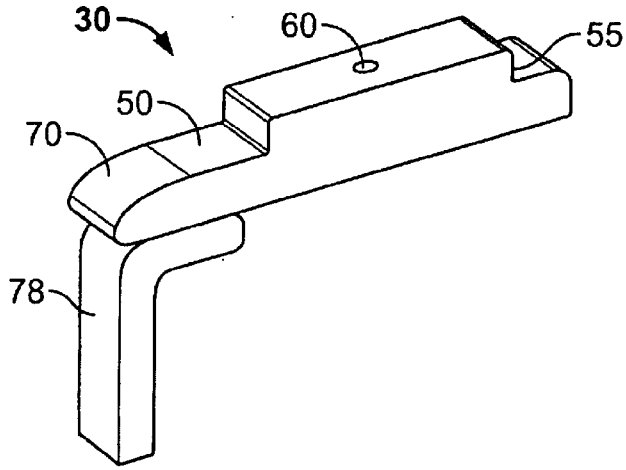
FIG. 3 shows a similar device to FIG. 1 with the added feature of a larger target for guiding the material onto the resting surface.
Figure 11:
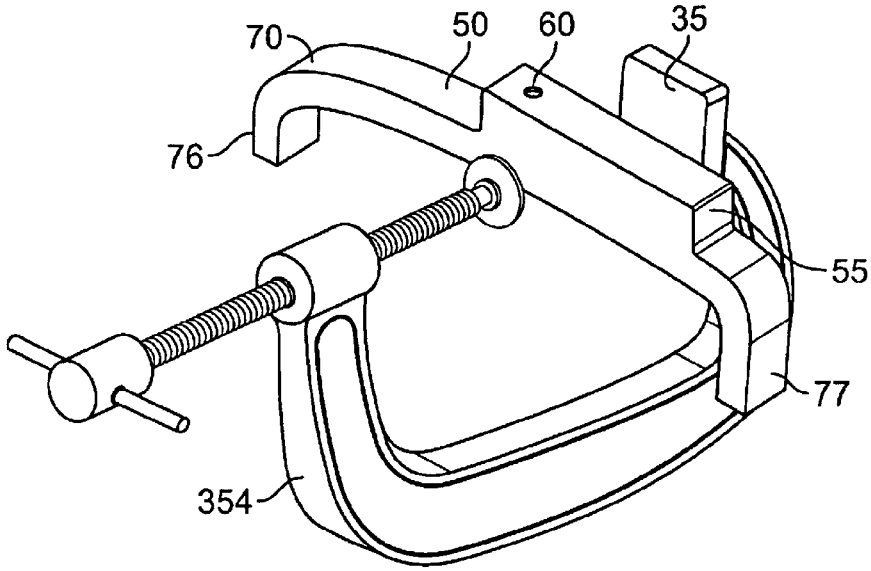
FIG. 11 shows a device similar to FIG. 4 shown in combination with a "c"-clamp.
Figure 12:
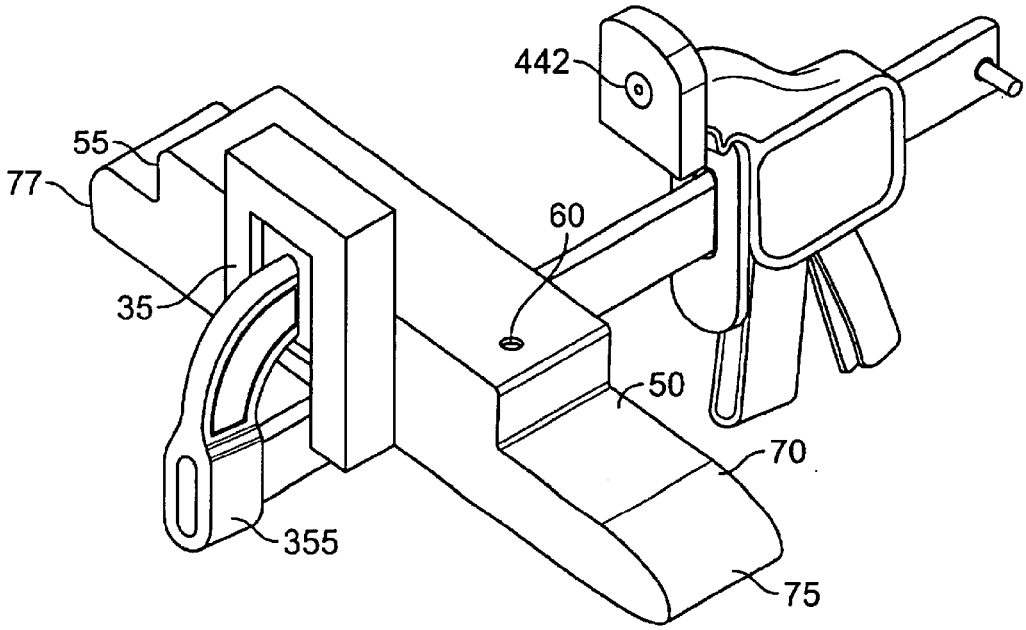
FIG. 12 shows a device similar to FIG. 4 shown in combination with a quick-grip bar clamp.

Several important aspects of the apparatus of the present invention are shown in FIGS. 1–3. As shown in FIG. 1, a device of the apparatus of the present invention 20 includes a resting surface 50 spaced apart from a fastener. As used herein, "fastener" may include at least one fastener opening 60 used in combination with a fastener component as described below; a device having a means of attaching a clamp to the device as shown in FIGS. 11, 12 and 14; a clamp as an integral part of the device as shown in FIGS. 9, 10, 13 and 15; and various combinations thereof.

Figure 4:
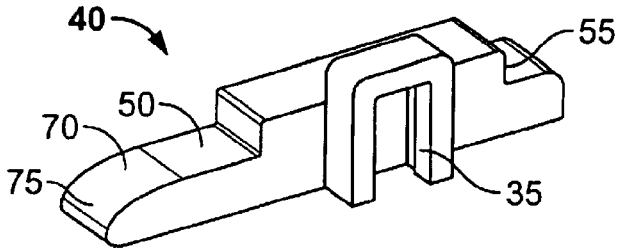
FIG. 4 shows a similar device to FIG. 1 with the added feature of a means of mounting the device onto a clamp.

In another aspect, the apparatus of the invention may further include a second resting surface 55, as shown in FIGS. 1 through 6 or a shortened resting surface 75 as shown in FIGS. 1, 2 and 4. In its basic form, the device of the invention only requires one resting surface, however, a second resting surface provides a user with added versatility at low cost.

Either one or both of resting surface 50 and second resting surface 55 may include a guide surface 70, a second continuous guide surface 76, an elongated continuous guide surface 77, a detachable guide surface 78, and combinations thereof. The guide surface 70, second continuous guide surface 76, and continuous elongated guide surface 77 may be continuous with the resting surface 50 and/or the second resting surface 55. In one aspect of the invention, the second resting surface 55 includes a continuous elongated guide surface 77, associated with it for use when putting sheeting on walls or cathedral ceilings.

In alternative aspects of the present invention, the guide surface 70 may generally extend downward from the plane of the resting surface 50. The downward extension of the resting guide surface 70 may be gradual, as shown in FIG. 1 or 2. Alternatively, a shown in FIGS. 5 and 6, and continuous elongated guide surface 77 may be at a more extreme angle. As shown in FIG. 3, the apparatus of the invention may also include a detachable elongated guide surface 78 which acts as a bigger target area for the installer(s) to find with the leading edge of a sheet of building material and to further facilitate the guiding of building materials to the resting surface 50.

In another aspect of the present invention, the apparatus for installing building materials may include at least one fastener opening 60. The fastener opening 60 may be an opening that passes completely through the apparatus 10. The fastener opening 60 has a diameter sufficient to allow any type of fastener component to be used with the apparatus. As used herein, "fastener component" means any type of screw, nail, rivet, or bolt that can be used to secure the apparatus or device generally designated 10, 20 or 30 to an exiting structure or support material. In this aspect of the invention, the fastener may pass through the fastener opening 60 and directly into a ceiling joist or wall stud, or first through a piece of building material before then passing into a ceiling joist or wall stud. The fastener component may allow the apparatus 10 to be circularly rotatable around its attachment point. The fastener opening 60 may also include a metal sleeve(s) or bushing(s) 65 in order to prolong the life of the device. Once the device of the invention is removed, a drywall screw is place into the hole left by the fastener, which removes any evidence that a fastener component passed through the building material. In an important aspect, the fastener component used is a drywall screw.

Another aspect of the present invention is shown in FIG. 4, where the apparatus includes a clamp adaptor 35 and does not include a fastener opening. In another aspect, as shown in FIG. 11, the apparatus may include both a fastener opening 60 and clamp adaptor 35. As used herein, the term "clamp" includes all clamp designs that can or could be modified to fit onto or be incorporated as an integral part of the design of the present invention. Examples of clamps include "C"-clamps, vicegrip, bar-clamps, and pony-clamps. The use of a clamp in combination with an apparatus of the invention that includes a clamp adaptor is shown in FIGS. 11, 12 and 14

Figure 5:
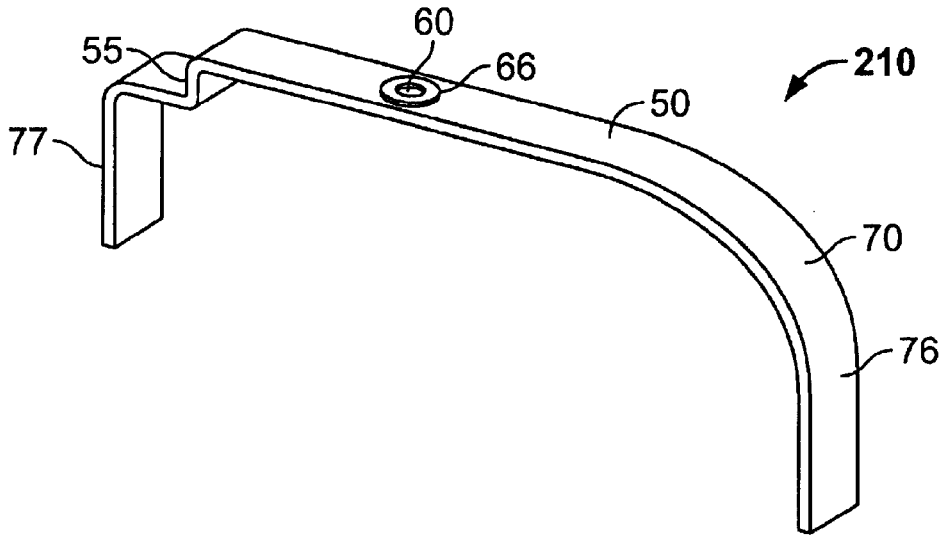
FIG. 5 illustrates a similar device to FIG. 2 formed in metal, or a composite or molded into a more streamlined part.

As shown in FIG. 5, the device generally designated 210 of the present invention may also include a continuous elongated guide surface 77 and a second continuous guide surface 76 that are perpendicular to the plane of the building materials being installed. These guide surfaces 76 and 77 aid the installer in contacting building materials with the device. In another aspect of the invention as shown in FIG. 5, the device may include a slightly raised surface 66 around the fastener opening 60. The raised surface 66 reduces the possibility of marking the building material during rotation of the device.

Figure 6:
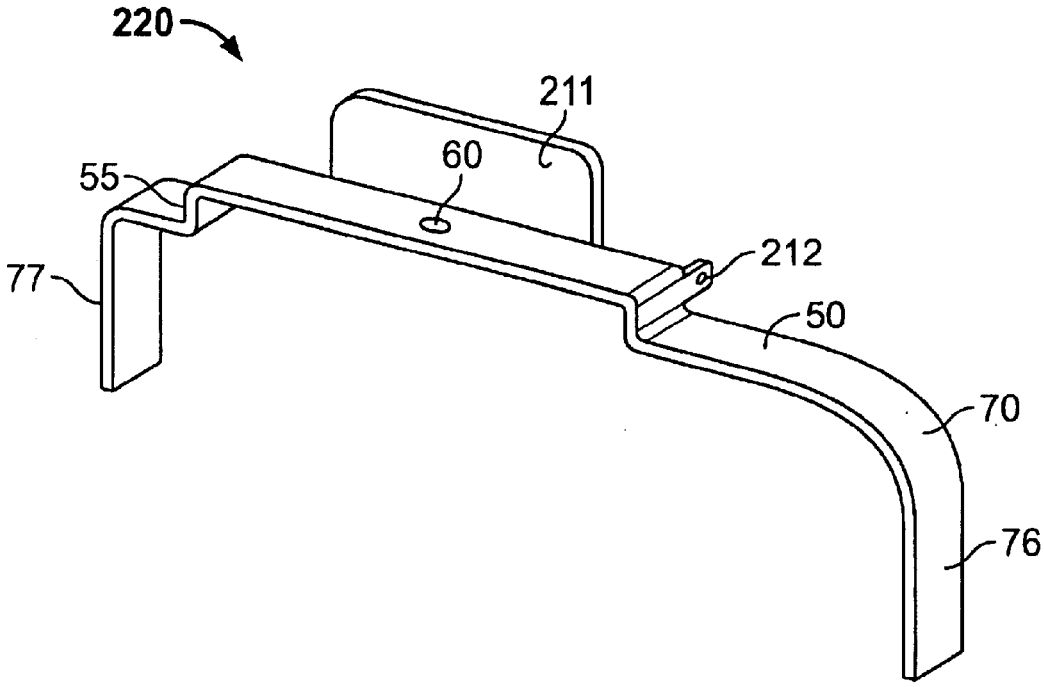
FIG. 6 shows a similar device to FIG. 1 formed in metal, or a composite, or molded with the added feature of an anti-rotational feature and a place to attach a means of adding a location feature, to reduce the time to mount the device.

A more streamlined version of the device 220 is shown in FIG. 6. In this aspect of the invention, the device 220 includes a resting surface 50 continuous with a guide surface 70 and a second continuous guide surface 76, and a second resting surface 55 continuous with an elongated guide surface 77.

Another aspect of the invention is shown in FIG. 6 where the apparatus 220 includes an anti-rotational feature 211 which may allow the device to be clamped to a support structure. The anti-rotational feature 211 also serves as an easy locator when addressing the device to the support structure, and also facilitates locating the mounting of the device by placing the fastener opening 60 roughly in the center of a standard 2" wide joist. Further, the apparatus may also include an attachment opening 212 for attaching a positioning device, such a chord. Hence, the measurements of the device are effective for properly locating the device to facilitate installation of building material.

Figure 7:
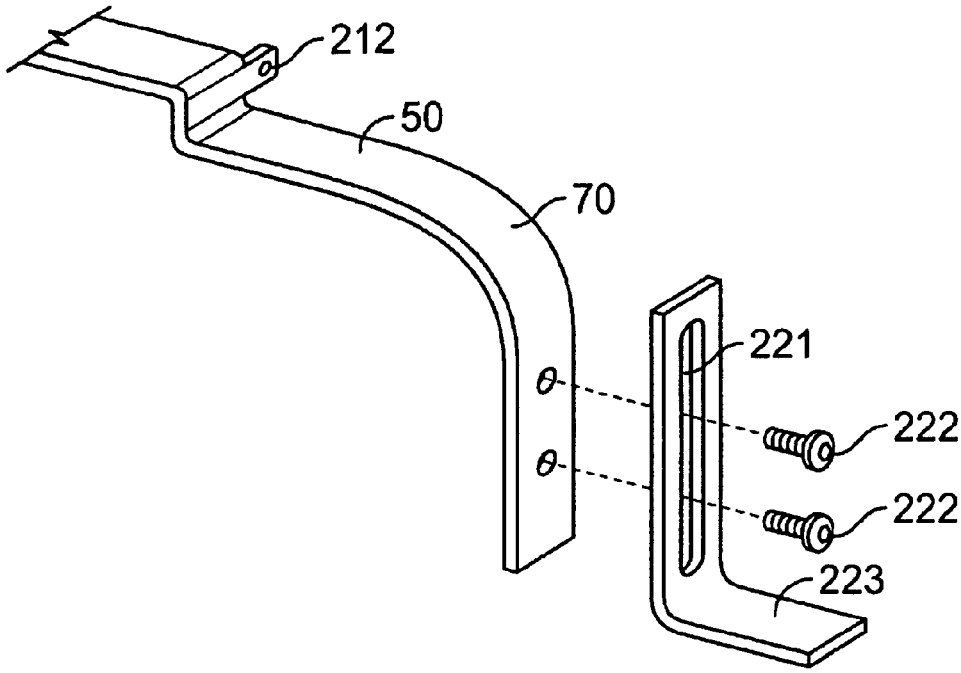
FIG. 7 illustrates a portion of the device of FIG. 6 with the added feature of an adjustable support.

Referring to FIG. 7, there is shown a means of adding another support surface 223. In this instance, the support surface 223 is shown as being attached via screws 222 and a slot 221 which allows adjustment of the location of the support surface 223. It is understood that a person skilled in the design can easily design other means of adjustment for this additional surface and these means are hereby included. This feature can be used as an extra pair of hands in supporting a framework that requires holding in place temporarily prior to permanent attachment, hence, allowing the carpenter to operate hands free.

Figure 8:
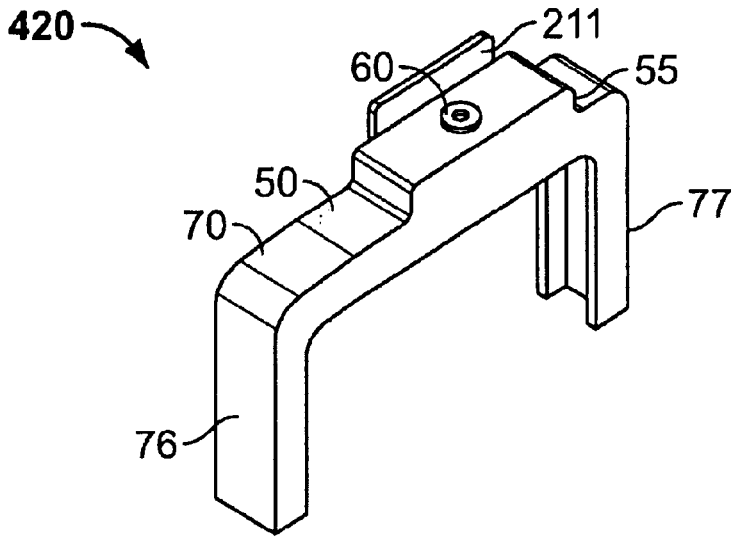
FIG. 8 shows a similar device to FIG. 1 with the added feature of an anti-rotational device.

Referring to FIG. 8, this figure shows a preferred one piece device generally designated 420. This device can be made from wood, molded from plastic, filled plastic, powdered metal or cast in metal. The device 420 includes a continuous elongated guide surface 77, a second continuous guide surface 76, an anti-rotational feature 211 and a fastener opening 60. If the device is made in plastic then it optionally may include an inserted bushing in the fastener opening 60. In devices made of powdered metal or metal this feature would not be required.

Figure 9:
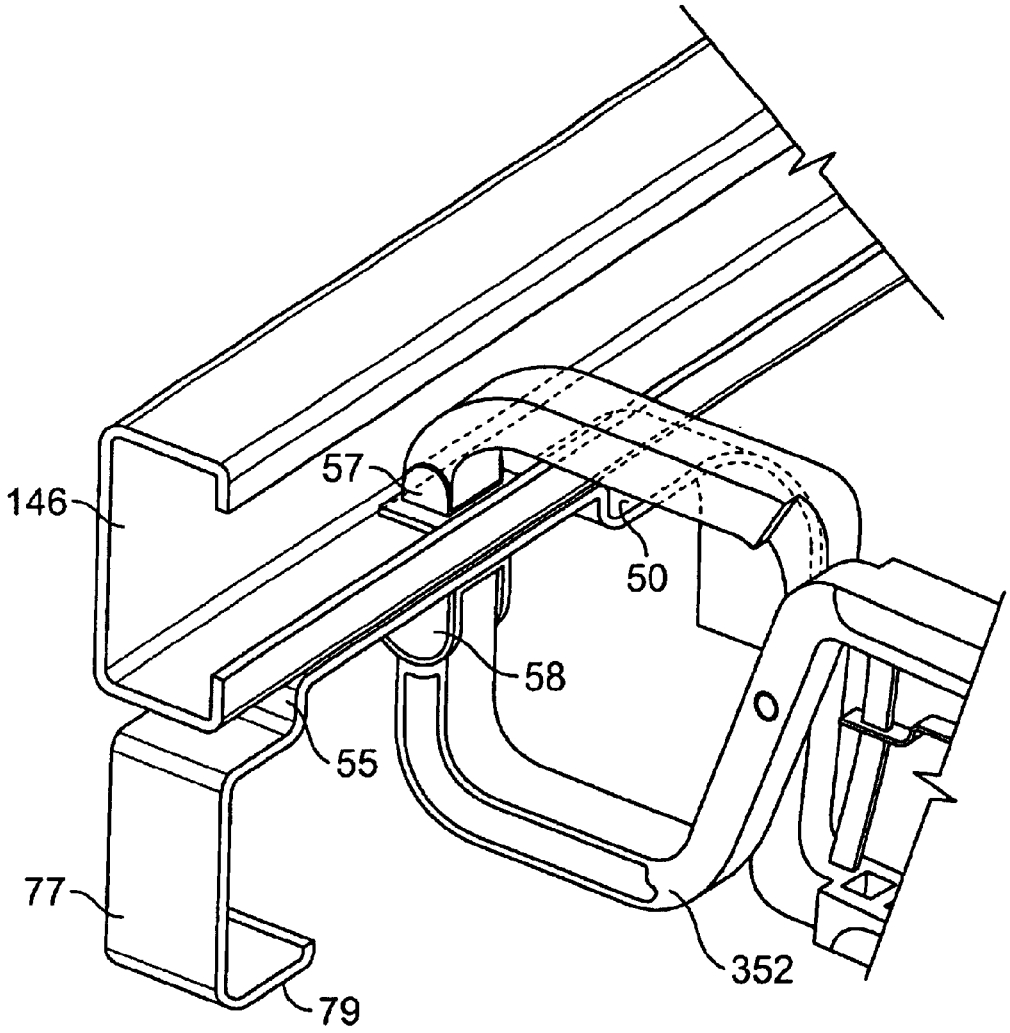
FIG. 9 shows a device similar to FIG. 6 illustrating a clamp as an integral part with the device of the invention for use when installing building material to metal joists.

Various aspects of the invention that include the use of the device in combination with a clamp are shown in FIGS. 9 through 15. Many styles of clamps are manufactured by various manufactures including Stanley, Craftsman, Wolfclamp, Pony clamp, Jorgenson, Bessey, Vice Grip, American Tool, plus numerous others which are hereby included in this invention. In an important aspect of the invention, the clamps used include bar clamps, quick grips, power press, cabinet clamp, euro claw, deep reach bar clamps, k-body clamps, vice grips, hand clamp, pony clamps, jorgenson clamps, c-clamps, ratchet clamps, and various other names and styles of these clamps with or without manufactures names that can readily be adapted or designed to accommodate, or have, the features of any or all of the above devices; and, are hereby included in this invention, As shown in FIG. 9, the device may be used in combination a hand-clamp 352 for use during the installation of sheet building material to metal studs. Both jaws have a pivoting feature 57 and 58 that permit the clamp surfaces to be parallel to each other when closed. As further shown in FIG. 9 is a folded surface 79 continuous with the elongated continuous guide surface 77. The folded surface 79 eliminates a sharp edge when using this style of device to install building material against a wall.

Figure 10:
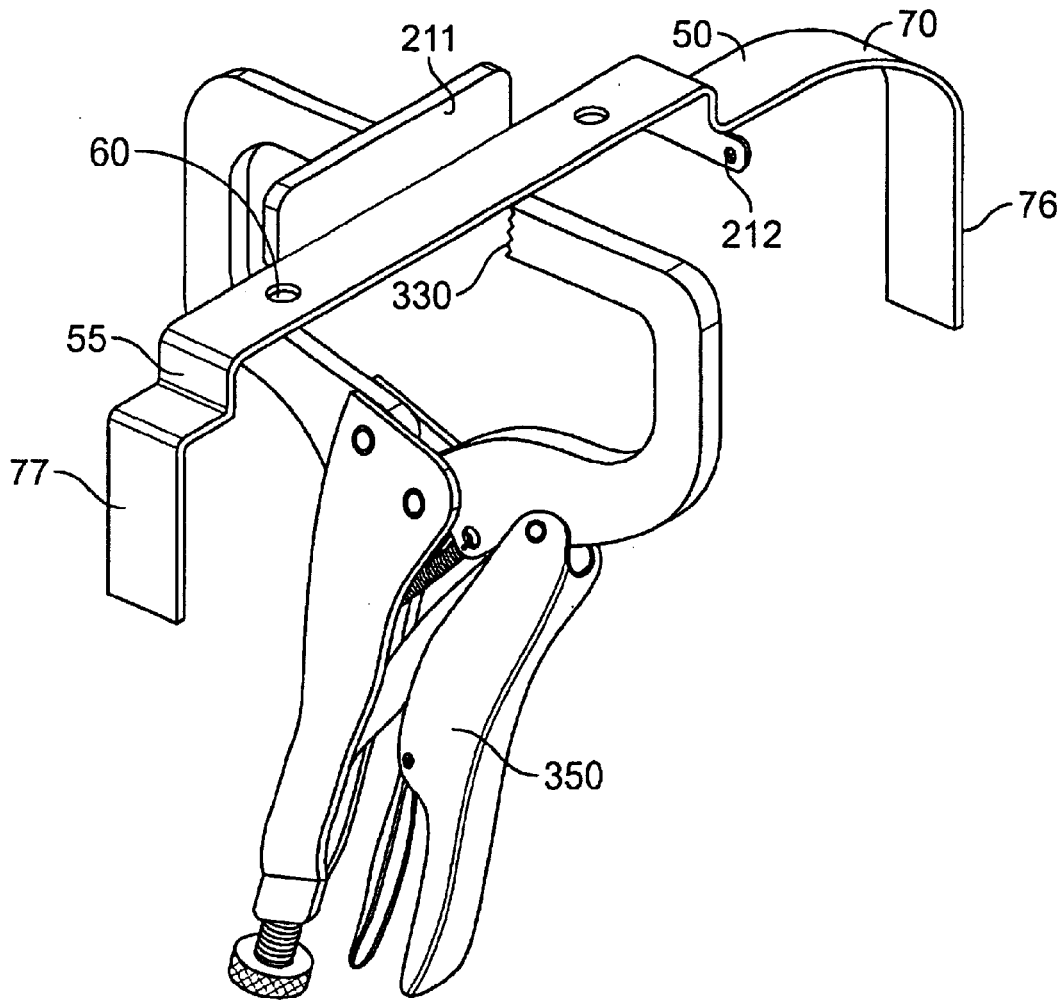
FIG. 10 illustrates a device similar to FIG. 6 illustrating a clamp as an integral part with the device of the invention.

The device of the present invention 320 in combination with a pair of vice grips 350 is shown in FIG. 10. The vice grips 350 may include serrated teeth 330 useful for biting into wooden joists to more firmly secure attachment of the vice grips 350 to a joist. The serrated teeth 330 may include a single point, multiple teeth, or any other design that would dig into a joist and be effective for securing the clamp to the joist.

The device of the present invention in combination with a "C"-clamp is shown in FIG. 11. FIG. 11 shows a device of FIG. 8 where the anti-rotational feature 211 is replaced with a clamp adaptor 35. The clamp adaptor 35 provides a surface where a "C"-clamp 354 can contact the device to secure it in place.

Referring to FIG. 12, this Figure shows a device of FIG. 4 in combination with a bar-clamp 355. In this aspect of the invention, the device includes a clamp adaptor 35 whereby the device can be slid onto one of the jaws of an existing style of bar-clamp 355. The opposing jaw of the bar-clamp may include an antislip feature 442. The antislip feature 442 may include single or multiple protrusions effective for securing the clamp to a wooden joist to prevent sliding of the clamp.

Figure 13:
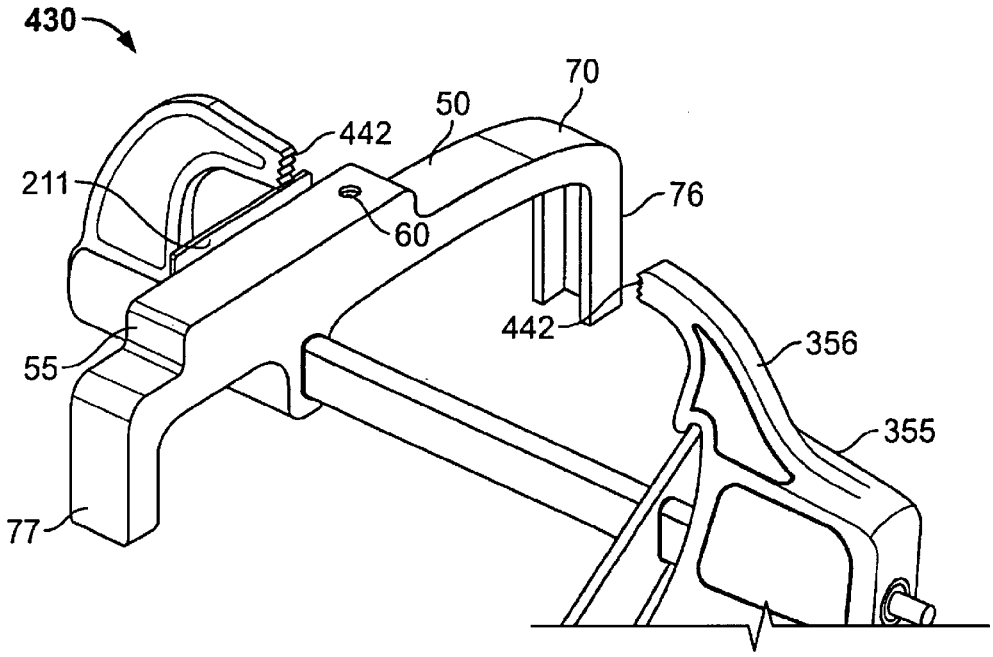
FIG. 13 illustrates a device similar to FIG. 3 illustrating a bar clamp as an integral part of the device of the present invention.
Figure 14:
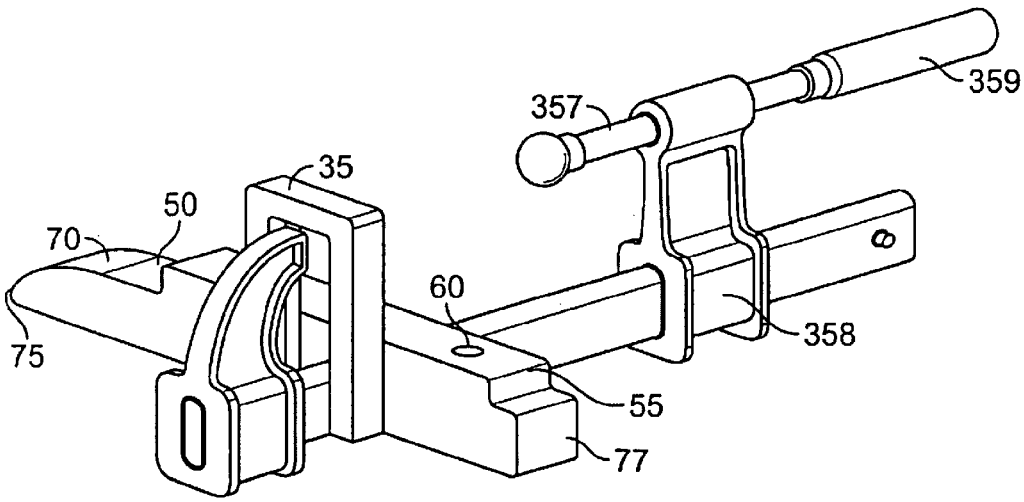
FIG. 14 shows a device similar to FIG. 4 in combination with a Jorgesen clamp.

Another aspect of the device of the present invention is shown in FIG. 13. The device of the 430 may be integrally combined with a bar-clamp 355 such that the device 430 and modified bar-clamp 355 are one piece. As shown in FIG. 13, both jaws are shown as having an anitslip feature 442 which is effective for bitting into a joist and preventing slippage. With a bar-clamp as shown in this FIG. 13 and FIG. 12 one of the jaws is stationary and generally part of the bar; while, the other moveable jaw 356 is moveable by means of a squeezing action that is perpendicular to the bar, an example of which is a quick-grip type clamp. Other styles of bar-clamps actuate the moveable jaw by a squeezing action parallel with the bar, an example of which is a EZ-hang type clamp and by means of a thread clamp such as a c-clamp.

Referring to FIG. 14, this figure shows another style of bar-clamp know as a Jorgesen clamp in combination with a device of FIG. 4. The moveable end 358 is first moved to a snug position then tightened up using the jaw mounted on a thread 357 by turning the handle 359.

Figure 15:
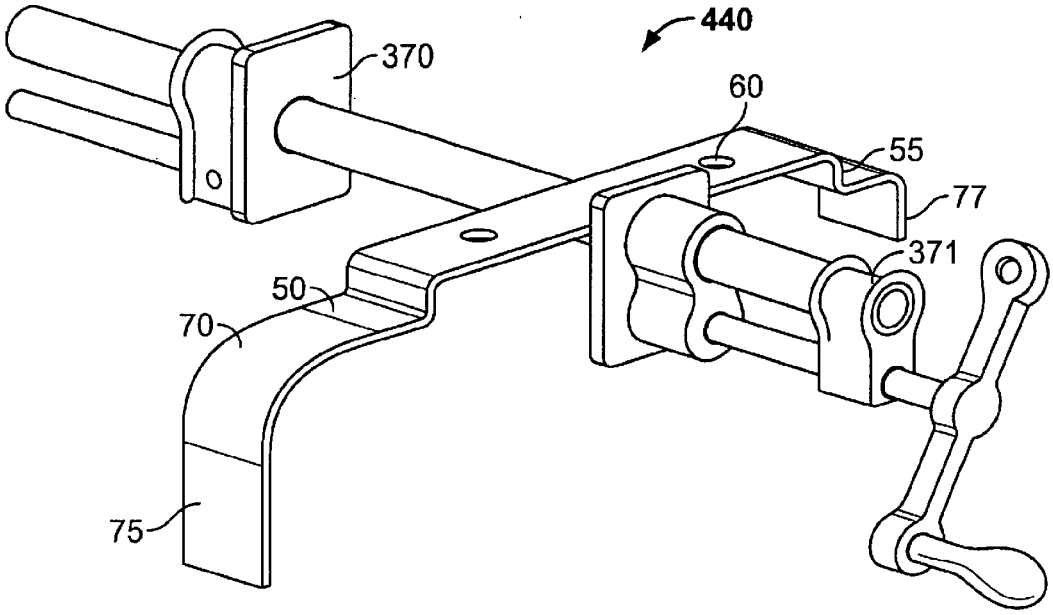
FIG. 15 shows a device similar to FIG. 4 in combination with a Pony clamp.

Another aspect of the invention is shown in FIG. 15. In this figure an apparatus generally designated 440 is shown in combination with a clamp known as a "pony clamp". The fixed end 371 of the clamp is screwed on to a piece of black pipe with the adjustable jaw 370 slid on to the pipe. The rough adjustment is done with the adjustable jaw 370 and the final tightening by cranking the handle on the fixed end. It is to be understood that any of the devices shown could be used in combination with any clamp either attached or as an integral part of the device of the invention.

Figure 16:
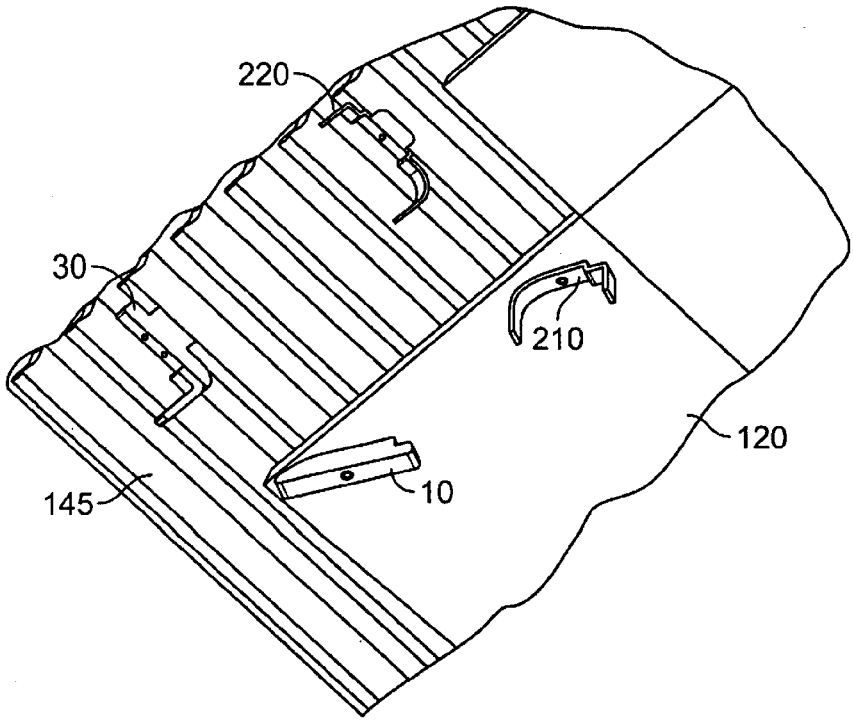
FIG. 16 is a view showing two styles of device in location ready to accept a sheet of building material.
Figure 17:
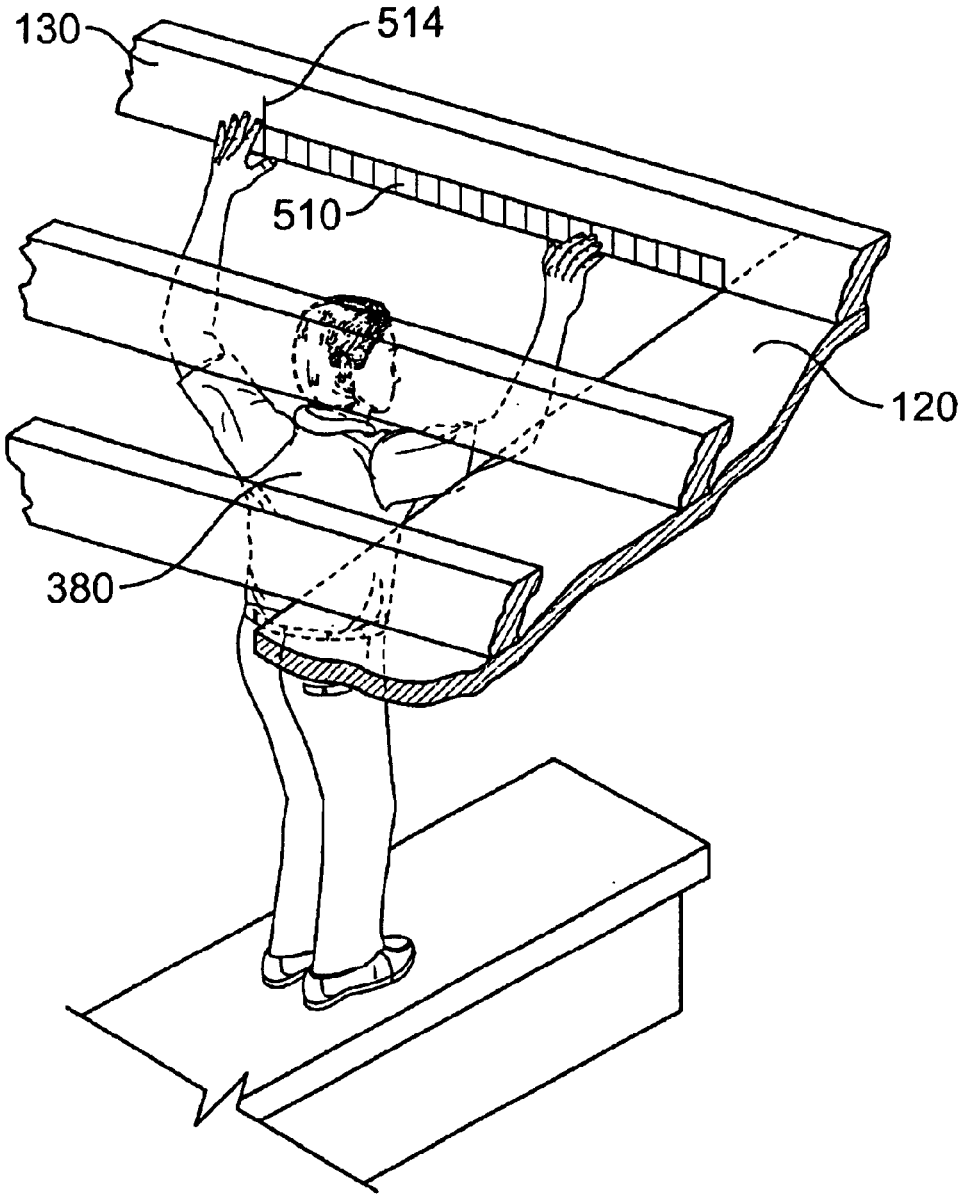
FIG. 17 is a view showing an installer using a rule to mark the location to mount one of the devices.
Figure 18:
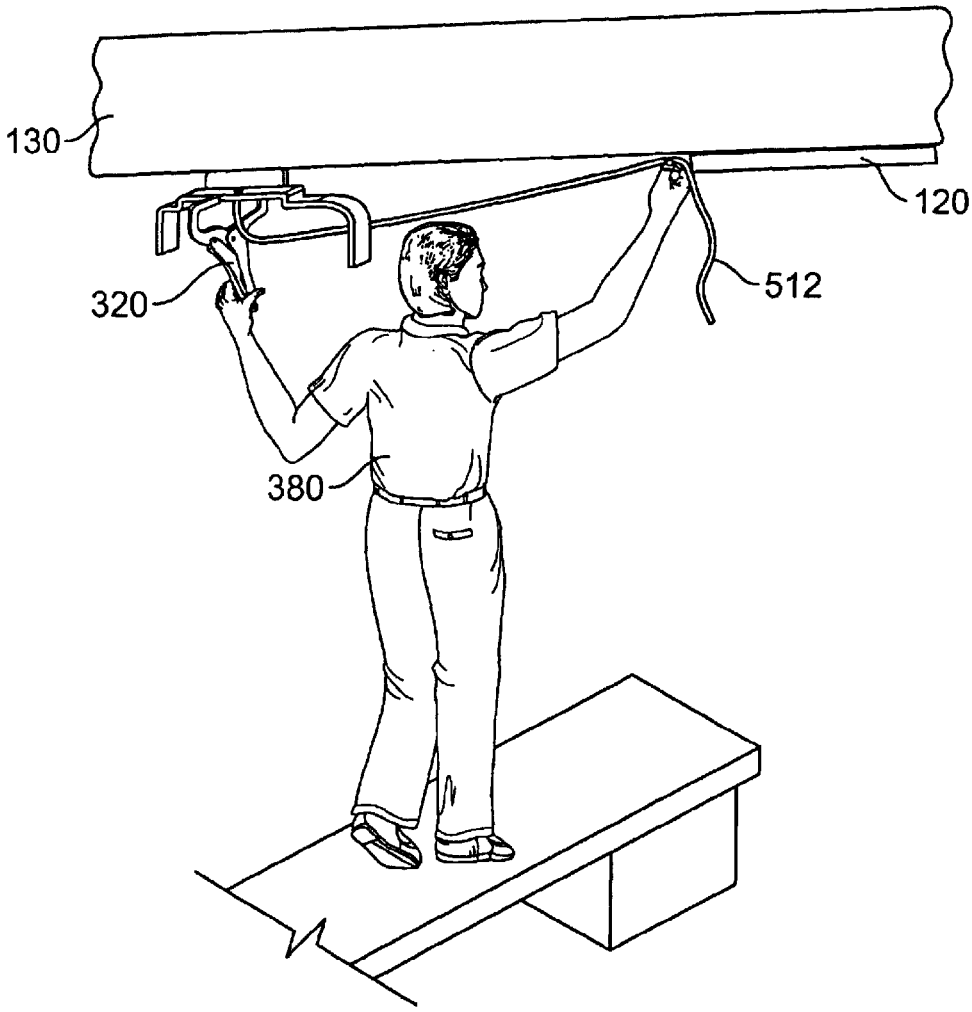
FIG. 18 is a view showing an installer using a flexible feature for locating the location to mount a clamp style device.

Various aspect of the use of devices of the present invention are shown in FIGS. 16–25 and positioning of the device of the present invention is shown in FIGS. 16–18. As can be seen in the Figures, each apparatus of the invention is positioned to facilitate installation of the first or next piece of building material. Referring to FIG. 16, in this figure two pair of styles of devices are shown in ceiling location ready to have a sheet of building material put in place. One device of each set is mounted on the ceiling joists 130 and the other mounted through the drywall 120 and into the ceiling joists 130. One style comprises of a pair of devices as reflected by 10 and 30; and the other pair's style are reflected by 210 and 220.

Referring to FIG. 17, this figure shows an installer 380 marking the location 514 on the ceiling joist 130 using a rule that is forty-eight an a half inched long. This distance is measured from the edge of a wall or a previously installed sheet. The half inch play is more than enough to place the sheet flush with the ceiling joist and leave little distance to move the sheet in order to put it in place for attachment most sheets of material are 4'×8' long or 4'×12' long; but, the metric equivalent of sheet sizes would be allowed for by a rule half an inch longer than the width of the metric standard for building material sheeting.

Another means of locating the device 320 to ceiling joist 130 is shown in FIG. 18. As shown, a flexible length of material 512 by holding a the predetermined mark on the flexible material against either the wall or previously attached sheet stretching it to its limit and attaching in this figure the clamp 320. Positioning of building material may be accomplished using a positioning device such as a chord 512 and/or measuring device 510.

Figure 19A:
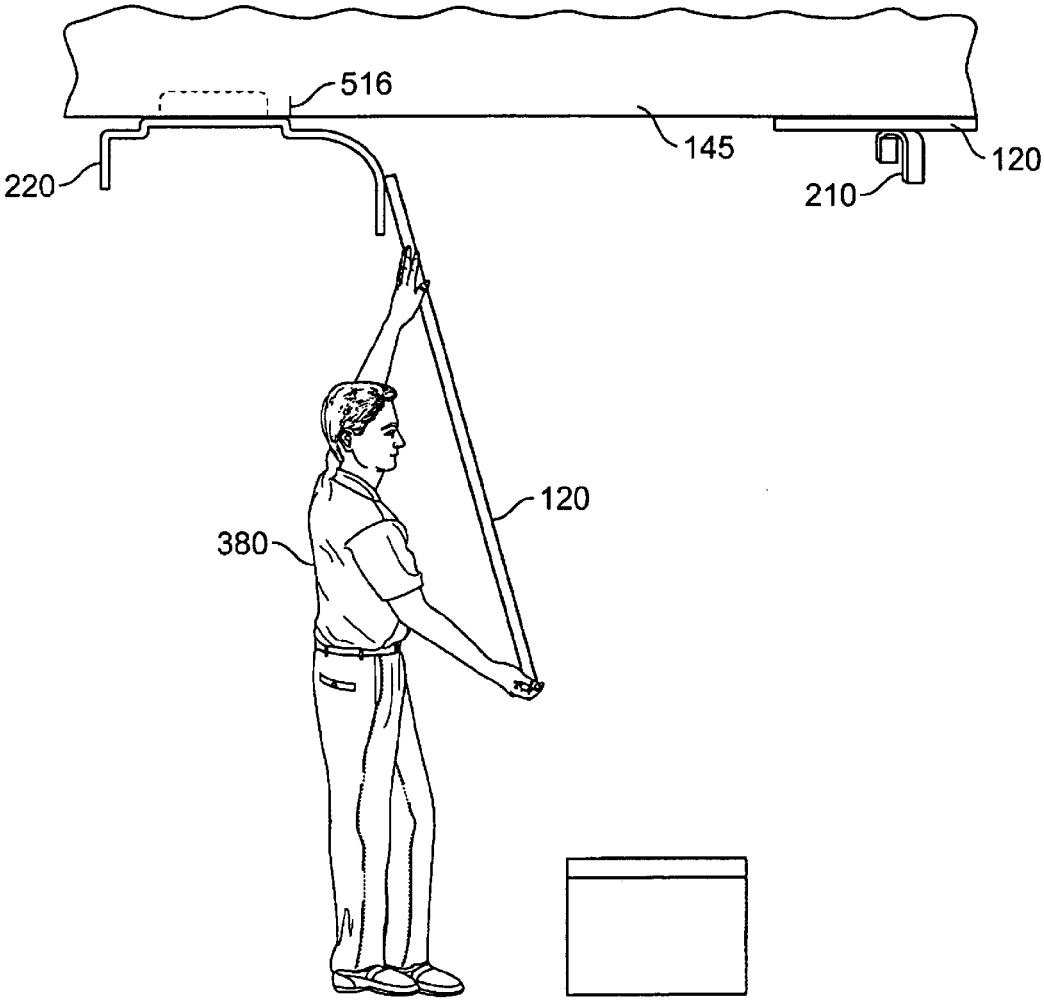
FIGS. 19A, B, C, & D shows a method for installing a sheet of building material overhead by one or more installers.
Figure 19B:
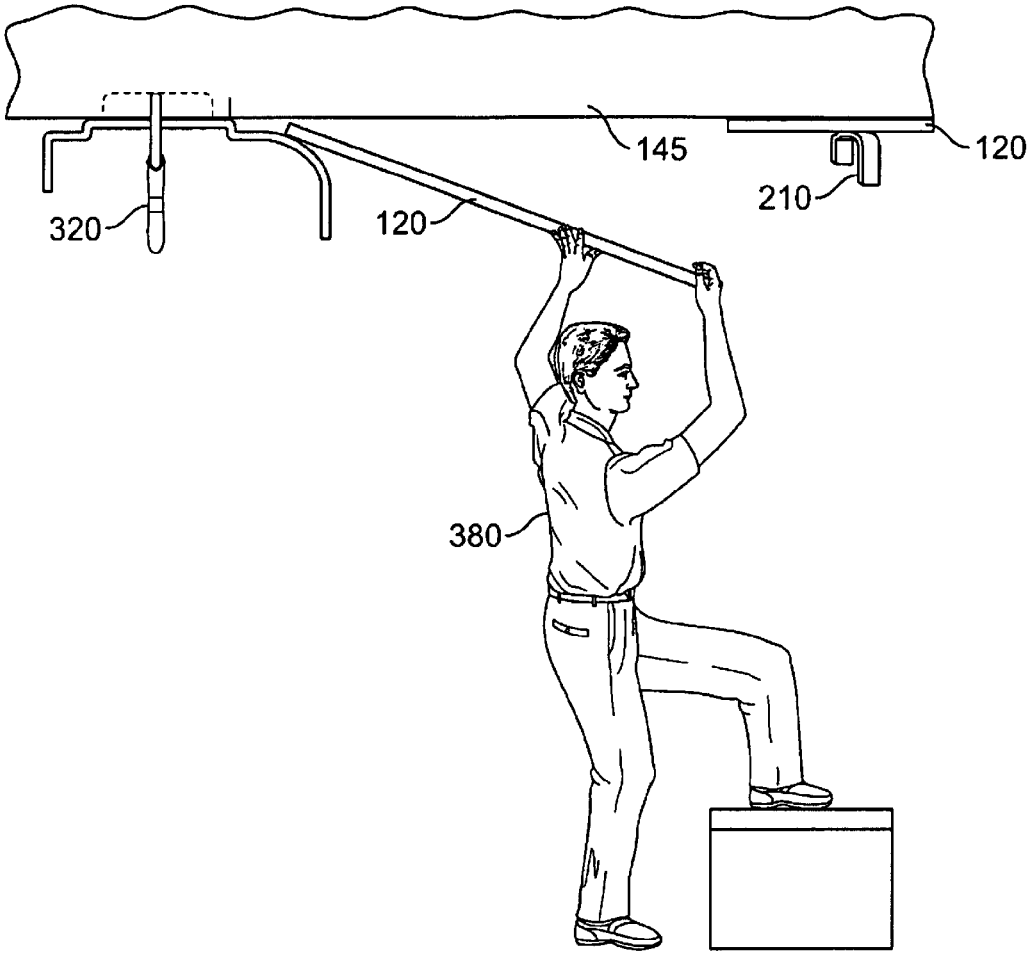
Figure 19C:
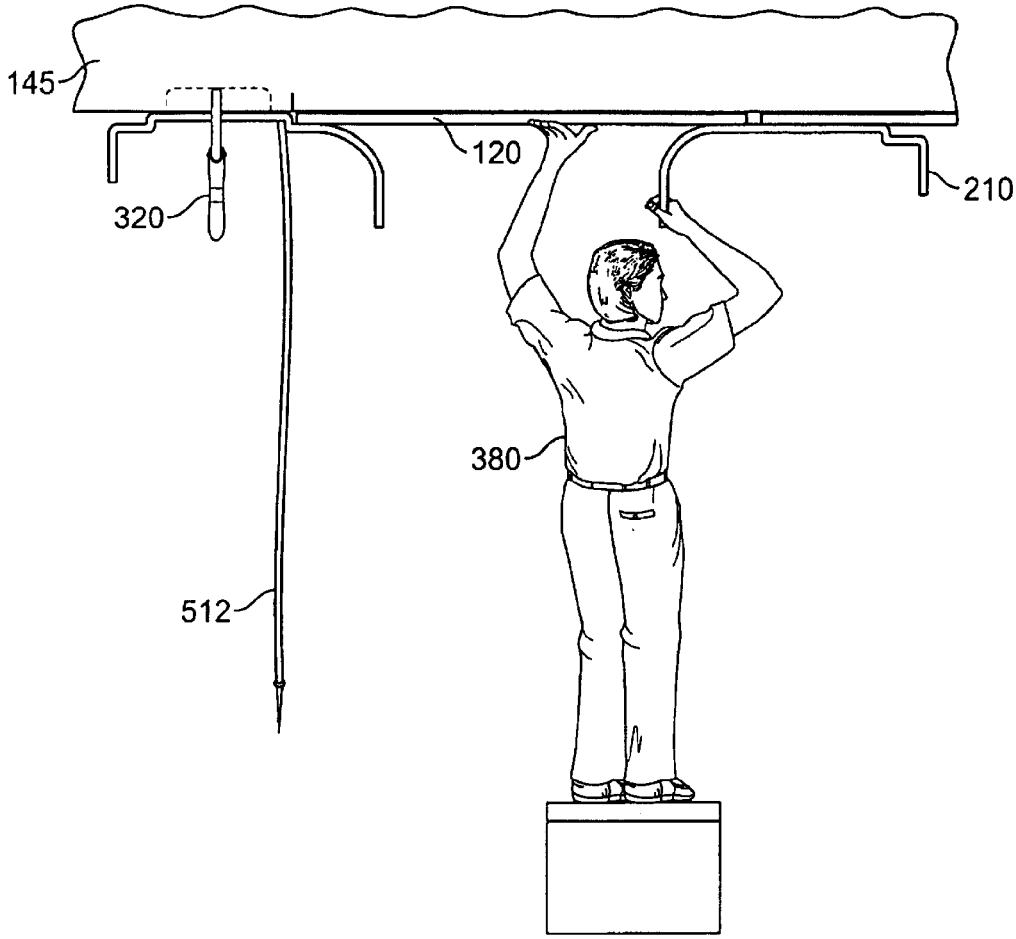
Figure 19D:
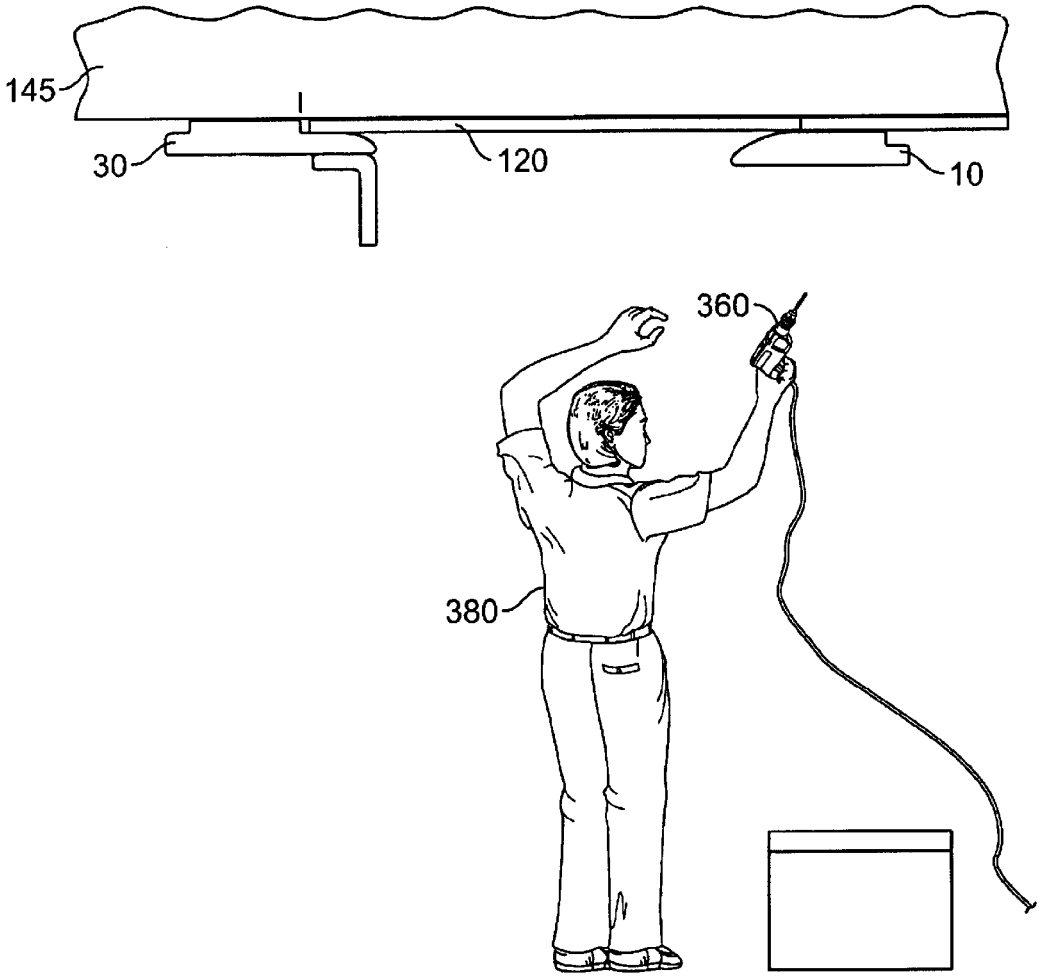

Installation of the building material 120 is shown in FIGS. 19A–D. Referring to FIGS. 19*a, b, c* & *d*, these views show a preferred method of installing building material sheets on a ceiling. In this illustration the installer 380 is putting up drywall. After marking the location and installing the devices the drywall 120 is lifted in the near vertical to vertical position and the top edge is engaged with the guide surface of the devices. Building material is then lifted up till it hits the ceiling joists, at which time maintaining a upwards pressure locate the leading edge of the drywall into the pockets created by the devices and ceiling joists as shown in FIG. 19*b*; and, rotate as shown in FIG. 19*b* into the horizontal position as shown in FIG. 19*c*. Then the device 210 is rotated into position to support the sheet of drywall 120. Then the installer is hands free to use his screw gun 360 to permanently mount the sheet of drywall as shown in FIG. 19*d*. When using these devices on an eight foot long sheet it is recommended that two sets of the devices be used; and, on a twelve foot long sheet three sets of these devices be used.

Figure 20:
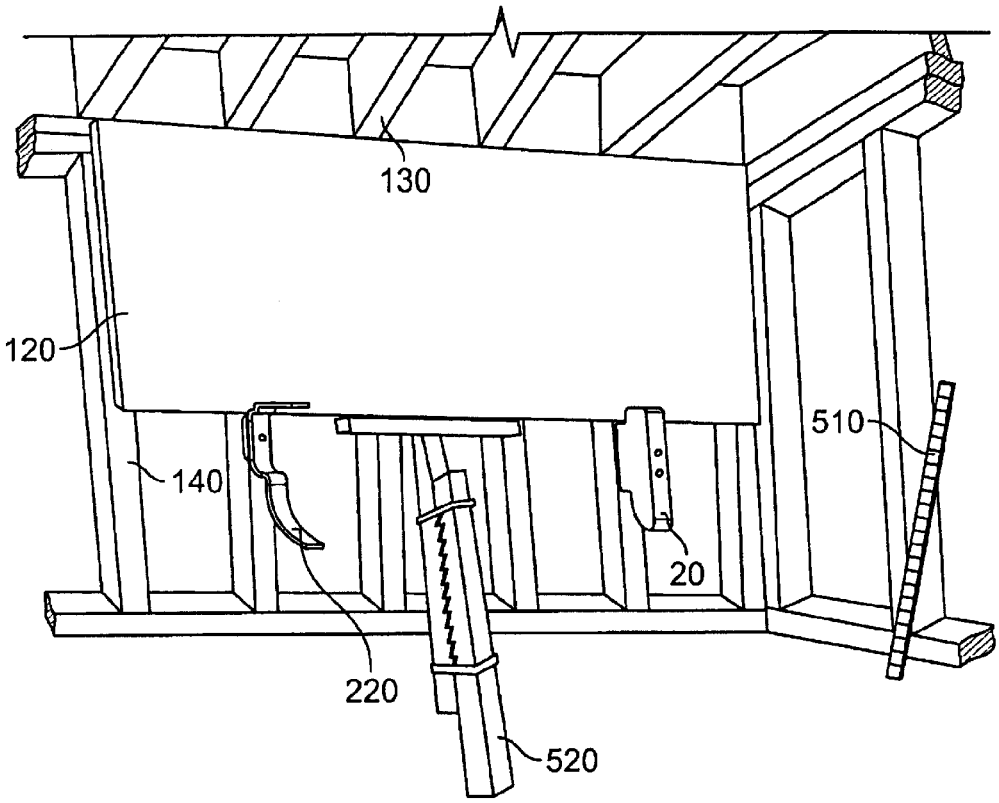
FIG. 20 shows a method of mounting a sheet of building material to a wall.

A method for installing building material on a wall is illustrated in FIG. 20. In accordance with the invention, an installer first marks the locations for mounting the device of the present invention using a measuring device 510. One of the marks made by the installer is just over four feet and the other at four feet and a half inches down from the ceiling. The devices of the inventions, shown as 20 and 220 are secured into position. Other devices of the invention may be used, for example, device 40 in combination with a clamp, device 420, device 320 as shown in FIG. 10, and device 430 in FIG. 13. The drywall 120 is placed into pockets created by the device of the invention and studs, and rotated into a vertical position. Then using a tee bar 520, the drywall 120 is manually raised so that the top edge of the drywall is flush with the ceiling. In a typical installation, the ceiling panels may already be in place, whereas, FIG. 20 shows an open ceiling.

Figure 21:
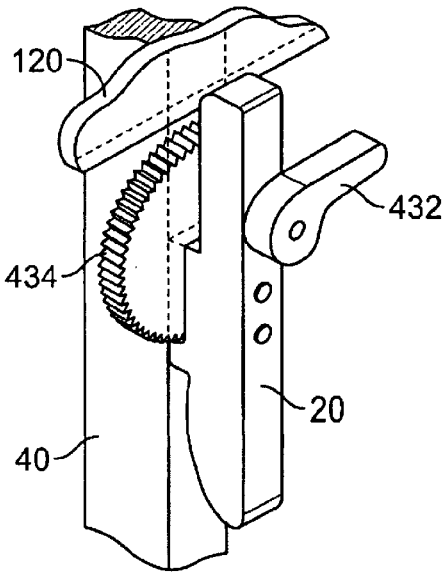
FIG. 21 shows one style of device having a cam action feature for raising a sheet of building material on a wall.
Figure 22:
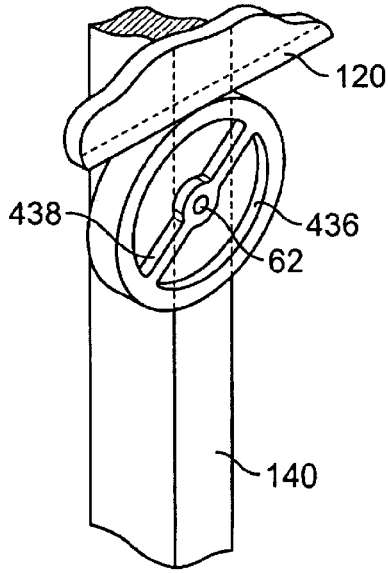
FIG. 22 shows another style of the device with another style of cam action.

An alternative method of raising building material is shown in FIGS. 21 and 22. Instead of using a tee-bar or manually raising the material, the material my be raised using a cam device as shown in FIG. 21 by rotating handle 432. With rotation, the excetric cam 434 raises the drywall 120.

Referring to FIG. 22, this figure shows another alternative method of raising a sheet of drywall 120 via another design of cam 436 which rotates around the mounting feature 62; and, by the means of twisting the cam using web 438 the drywall sheet is raised.

Figure 23:
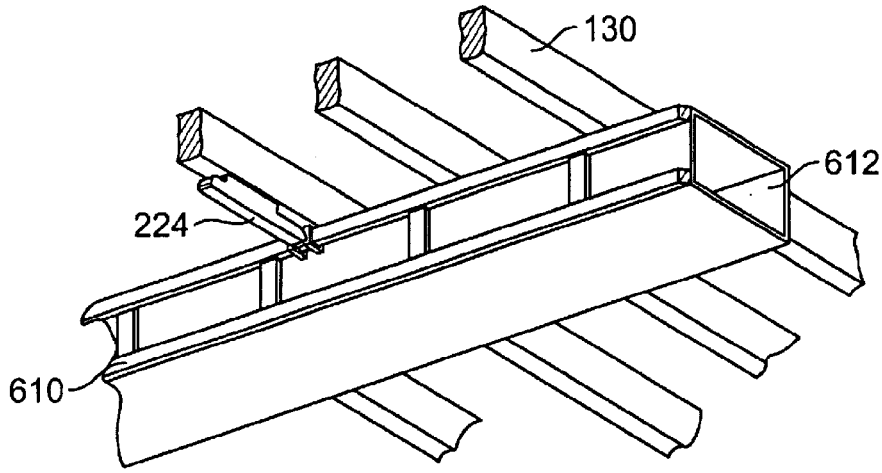
FIG. 23 shows one of the devices of FIG. 7 in use as an extra set of hands during the framing out of duct work.

An alternative use of the device of the present invention is shown in FIG. 23. In this figure, a device with an adjustable additional surface 224, as illustrated by the feature in FIG. 7, is shown attached to a ceiling joist 130 and acting as an extra pair of hands to hold the frame work 610 while framing out ductwork 612, thus leaving the installers hands free to adjust and secure the framework.

Figure 24:
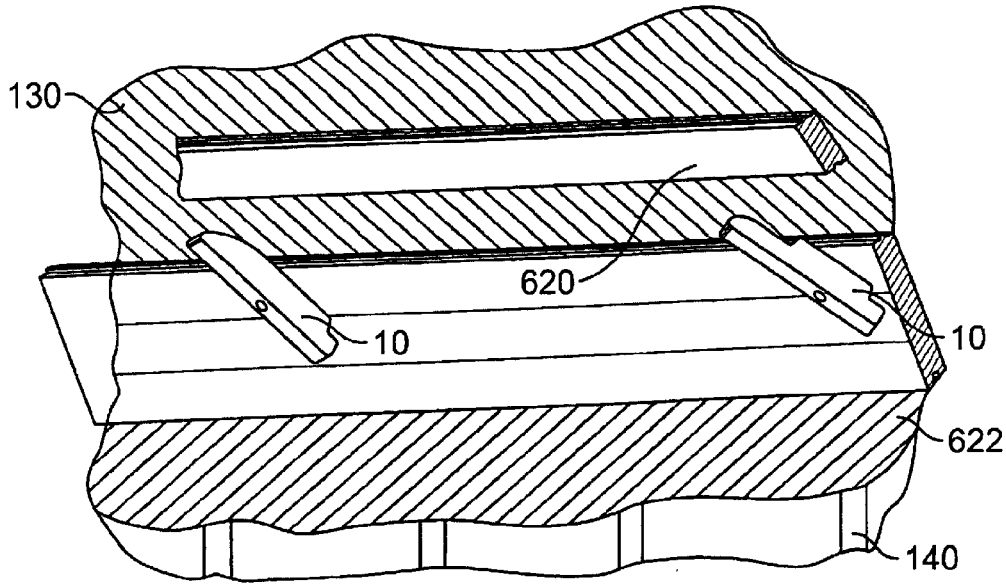
FIG. 24 shows two of the devices of FIG. 2 in use as an extra set of hands during the installation of a tongue & grooved ceiling.

Another use of the device of the present invention is shown in FIG. 24. In this figure a pair of the devices 10 are used to support and place long tongue and grooved planks 620 into a location against ceiling joists 130, thus, freeing up the installer to secure the planks. It is understood that anybody skilled in the art of construction can readily see using these devices to mount numerous types of building materials on walls or ceilings. Although the devices designated 10 are shown in the figure it is understood that it could just as easily be the device of FIG. 5 or FIG. 25 and are thereby included in this invention.

Figure 25:
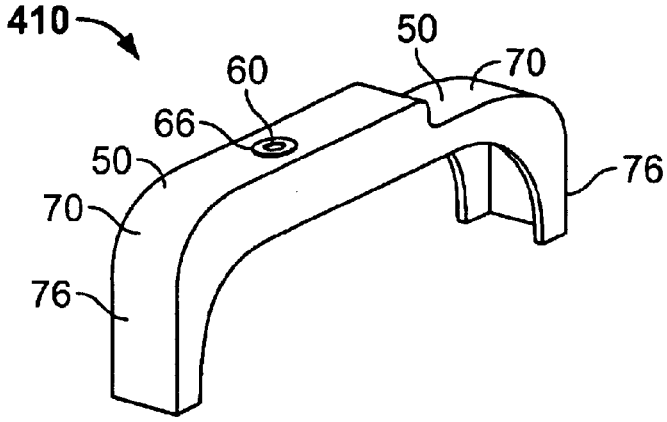
FIG. 25 shows a similar device to FIG. 5 with two sets of the same guide and resting surfaces, with one set being a distance from the surface that is adjacent to the building material surface.

Referring to FIG. 25, this figure shows a preferred one piece device generally designated 410. This device can be made from wood; molded from plastic; filled plastic; powdered metal or cast in metal reflected are the three guide surfaces 70, 76 and 77, on both sides of the fastener opening 60. As shown in this figure one set of the surfaces is spaced at distance from the adjacent surface that contacts the structure surface to which the device is mounted. If the device is made in plastic then it possibly may include an inserted bushing. In powdered metal or metal this feature would not be required. Also shown is a raised area 66 which is not essential to the device provides a added advantage of reducing possible marking of the building material surface when being rotated into position.

Figure 26:
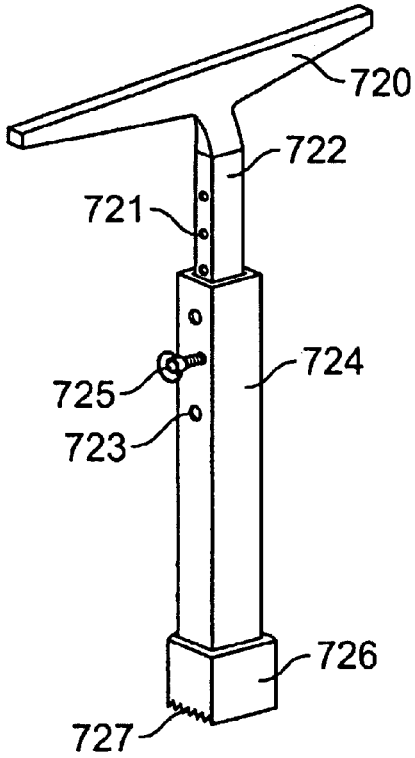
FIG. 26 shows an adjustable tee-bar for assisting in the application of building materials.

Referring to FIG. 26, this figure shows an adjustable tee support comprising of a head piece 720 two tubular vertical support piece 722 and 724 which slide one inside the other. Holes 721 and 723 that allow a pin 725 to be placed through both tubes in order to facilitate different heights of use; and, although not necessary for the function of the tee-bar a boot 726 with a roughened base 727 to stop marking the floor. It is understood that anybody skilled in the art could modify the design with a removable head to facilitate storage or transportation, add a coating to the head or make it out of a material that will reduce or eliminate marking the building material, or make the head with limited rocking ability.

Figure 27:
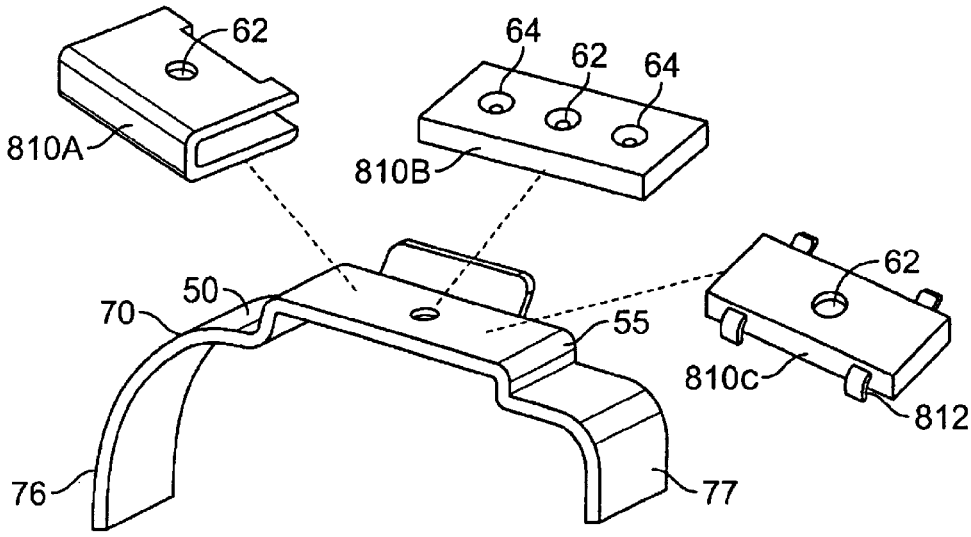
FIG. 27 shows another feature of the device in that spacer pads can be added to the surface adjacent to the building material surface in order to vary the spacing whereby different thickness, of building materials can be installed.

Referring to FIG. 27, this figure shows an additional feature of the present invention for adding space between the apparatus of the present invention and the building material being installed. This feature provides the installer with the ability to install a varity of different thicknesses of building material with the same basic device. In this figure three designs of height block 810*a*, 810*b* and 810*c* are shown. The height block 810*a* shows an extrusion with a clearance hole 62 for the means of mounting the device to the structure. The height block 810*b* is a block with mounting holes 64 and clearance hole 62. The height block 810*c* shows a design with clip on feet 812 and a clearance hole 62.

Figure 28:
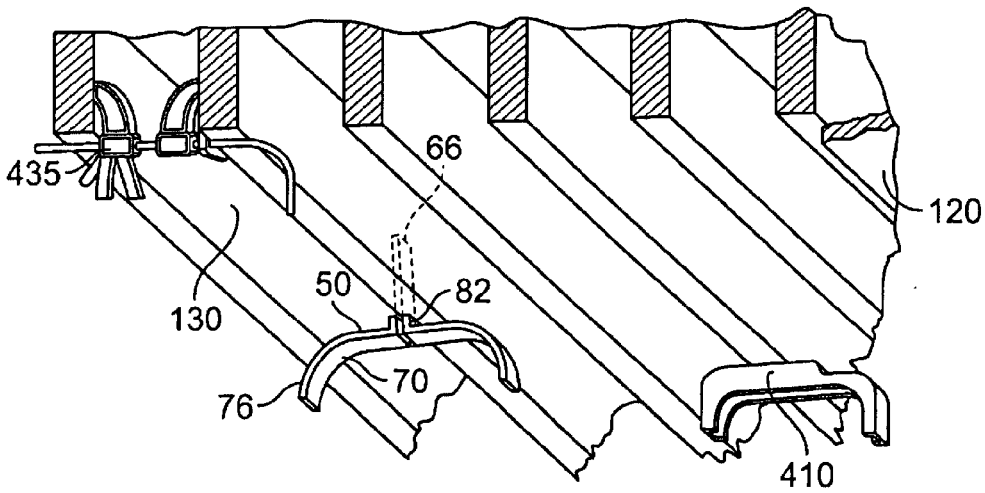
FIG. 28 shows that the device can also be readily adapted for installation of building materials parallel to the ceiling joists.

Referring to FIG. 28, this figure shows the device of FIG. 26 having two sets of the same guides 76 and 70. Also two surfaces 50 with a center mounting post and means of attachment 66 mounted at right angles to the ceiling joist 130. An additional stop 82 is added to give the required gap for the building material to be inserted. In accordance with the invention, building material is raised vertically to near vertical to contact guide surface 76. The building material is lifted and rotated into position and device 410 is rotated to support the building material. Further shown is an alternative bar clamp design in which the jaws open instead of close. It is understood that any competent designer can add this feature to many of the designs of clamp and are hereby included in this invention.

Numerous modifications and variations in practice of the invention are expected to occur to those skilled in the art upon consideration of the foregoing detailed description of the invention. Consequently, such modifications and variations are intended to be included within the scope of the following claims.

What is claimed is:

1. A method for installing building material comprising:

positioning at least one apparatus for installing building materials;

attaching the apparatus to an existing structure by means of a removable fastener associated with a first surface of the apparatus;

positioning the building material on a target surface and moving the building material to a resting surface;

positioning the building material to a desired location and temporarily securing the building material; and permanently securing the building material to the existing structure, wherein the apparatus comprises, the first surface attached to the resting surface, at least one guide surface continuous with the resting surface and extending away from a plane of the resting surface, and the target surface being continuous with the guide surface extending away from the plane of the resting surface.

2. The method of claim 1 wherein the apparatus further comprises a fastener spaced apart from the resting surface.

3. The method of claim 2 wherein the apparatus further comprises at least one guide surface continuous with the resting surface and extending away from the plane of the resting surface, wherein the building material is contacted with the target surface in a vertical or near vertical position, moved to the guide surface, and moved to the resting surface.

4. The method of claim 2 wherein the fastener is a fastener opening in the first surface in combination with a fastening component effective for securing the apparatus to the existing structure.

5. The method of claim 2 further comprising a second resting surface.

6. The method of claim 5 further comprising at least one guide surface continuous with the second resting surface and extending away from a plane of the second resting surface.

7. The method of claim 6 further comprising a second target surface continuous with the guide surface and extending away from a plane of the second resting surface.

8. The method of claim 1 wherein the apparatus further comprises a positioning feature.

9. The method of claim 2 wherein the apparatus further comprises at least one material thickness spacer.

10. The method of claim 2 wherein the apparatus further comprises at least one adjustable support surface.

11. The method of claim 2 wherein the apparatus for installing building material is made from a material selected from the group consisting of wood, metal, plastic, and combinations thereof.

12. The method of claim 2 wherein the apparatus further comprises an adjustable tee support.

13. An apparatus for installing building materials comprising:

a first surface comprising a fastener, the first surface attached to a resting surface and a second resting surface, wherein the resting surface and second resting surface are not in the same plane as the first surface, a guide surface continuous with the resting surface and extending away from a plane of the resting surface and a second guide surface continuous with the second resting surface and extending away from the plane of the second resting surface; and a target surface continuous with the guide surface and extending away from a plane of the resting surface and a second target surface continuous with the second guide surface and extending away from the plane of the second resting surface wherein the second resting surface is parallel or nearly parallel to the target surface.

14. The apparatus of claim 13 wherein the fastener is spaced apart from the resting surface.

15. The apparatus of claim 14 wherein the fastener is a fastener opening in the first surface in combination with a fastening component.

16. The apparatus of claim 13 wherein the fastener is a clamp adaptor and clamp.

17. The apparatus of claim 13 wherein the fastener is a clamp.

18. The apparatus of claim 17 wherein the clamp is selected from the group consisting of c-clamps, pony clamps, Jorgensen clamps, EZ hold clamps, bar clamps, power press clamps, cabinet clamps, euro claw clamps, deep reach bar clamps, k-body clamps, hand clamps, ratchet clamps, quick grip bar clamps, vice grip clamps, and combinations thereof.

19. The apparatus of claim 18 wherein the clamp has at least one means for penetrating into a support structure to enhance securing the apparatus in place.

20. The apparatus of claim 17 wherein the clamp is an integral part of the apparatus.

21. The apparatus of claim 13 wherein the apparatus for installing building material further comprises an anti-rotational feature.

22. The apparatus of claim 13 further comprising a positioning feature.

23. The apparatus of claim 13 further comprising at least one material thickness spacer.

24. The apparatus of claim 14 further comprising at least one adjustable support surface.

25. The apparatus of claim 13 wherein the apparatus for installing building material is made from a material selected from the group consisting of wood, metal, plastic, and combinations thereof.

* * * * *

UNITED STATES PATENT AND TRADEMARK OFFICE

CERTIFICATE OF CORRECTION

PATENT NO. : 6,904,732 B1
DATED : June 14, 2005
INVENTOR(S) : Frank M. Richmond

It is certified that error appears in the above-identified patent and that said Letters Patent is hereby corrected as shown below:

Title page,
Item [76], Inventor, change "Haryard" to -- Harvard --.

Signed and Sealed this

Thirteenth Day of December, 2005

JON W. DUDAS
*Director of the United States Patent and Trademark Office*